United States Patent [19]

Lo

[11] Patent Number: 4,986,533

[45] Date of Patent: Jan. 22, 1991

[54] MAGNETICALLY CONTROLLED EXERCISE BICYCLE FOR EXERCISING ARMS AND LEGS

[76] Inventor: Peter K. Lo, P.O. Box 13-124, Taipei, Taiwan

[21] Appl. No.: 560,799

[22] Filed: Jul. 30, 1990

[51] Int. Cl.[5] ..... A63B 21/00

[52] U.S. Cl. ..... 272/73; 272/129

[58] Field of Search ..... 272/73, 71, 72, 129, 272/97, 116, 131, 132; 74/48; 128/25 R

[56] References Cited

U.S. PATENT DOCUMENTS 4,822,032 4/1989 Whitmore et al. ..... 272/129

4,852,872 8/1989 Lo ..... 272/73

4,889,335 12/1989 Chen ..... 272/73

*Primary Examiner*—Stephen R. Crow

[57] ABSTRACT

An exercise bicycle includes a frame assembly, a front wheel, a rear wheel, an intermediate shaft, two swing levers and two pedals. The front wheel is rotated by actuating the swing levers, while the rear wheel is rotated by actuating the pedals. The rotation of the front wheel and/or the rear wheel is transferred to the intermediate shaft. A resistance generating device includes a driving wheel sleeved rigidly on the intermediate wheel, a rotating shaft journalled on the frame assembly of the exercise bicycle, an input wheel sleeved rigidly on the rotating shaft, an endless driving element transferring the rotation of the driving wheel to the input wheel, a generator creating electric current when the rotating shaft rotates, and a resistance setting device connected to the generator. The resistance setting device adjusts the magnetic resistance of the generator to the rotation of the rotating shaft depending on the intensity of the current signal created by the generator. The higher the rotational speed of the rotating shaft, the greater the magnetic resistance to the rotation of the rotating shaft, thus increasing the exercise effect.

6 Claims, 3 Drawing Sheets

MAGNETICALLY CONTROLLED EXERCISE BICYCLE FOR EXERCISING ARMS AND LEGS

BACKGROUND OF THE INVENTION

This invention relates to an exercise bicycle for exercising arms and legs, more particularly to a magnetically controlled exercise bicycle.

I disclosed in my U.S. Pat. No. 4,824,102 an exercise bicycle for exercising arms and legs which includes a resistance generating device. The resistance generating device of the exercise bicycle consists of a suspended wheel which has a number of generally racially extending wheel blades, which create air impedance to the rotation of the suspended wheel. The higher the rotational speed of the wheel, the greater the air impedance resisting rotation of the wheel. However, this resistance-generating device is too bulky to easily mount on the frame of an exercise bicycle.

SUMMARY OF THE INVENTION

It is therefore the main object of this invention to provide an exercise bicycle with a compact resistance generating device which has a magnetic controller.

According to this invention, an exercise bicycle includes a frame assembly, a front wheel, a rear wheel, an intermediate shaft, two swing levers and two pedals. The front wheel is rotated by actuating the swing levers, while the rear wheel is rotated by actuating the pedals. The rotation of the front wheel and/or the rear wheel is transferred to the intermediate shaft. A resistance generating device includes a driving wheel sleeved rigidly on the intermediate wheel, a rotating shaft journalled on the frame assembly of the exercise bicycle, an input wheel sleeved rigidly on the rotating shaft, an endless driving element transferring the rotation of the driving wheel to the input wheel, a generator creating electric current when the rotating shaft rotates, and a resistance setting device connected to the generator. The resistance setting device adjusts the magnetic resistance of the generator to the rotation of the rotating shaft depending on the intensity of the current signal created by the generator. The higher the rotational speed of the rotating shaft, the greater the magnetic resistance to the rotation of the rotating shaft, thus increasing the exercise effect.

BRIEF DESCRIPTION OF THE DRAWING

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
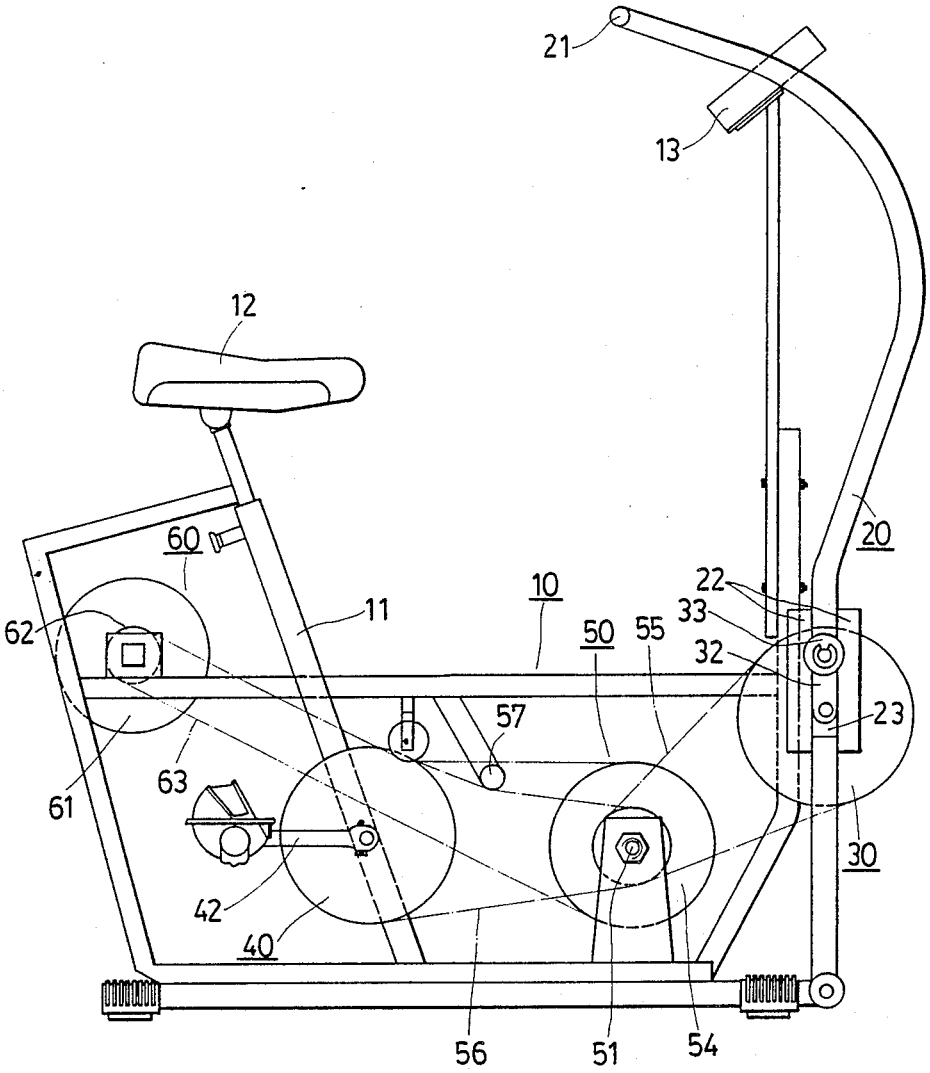
FIG. 1 is a side view showing a magnetically controlled exercise bicycle according to this invention.
Figure 2:
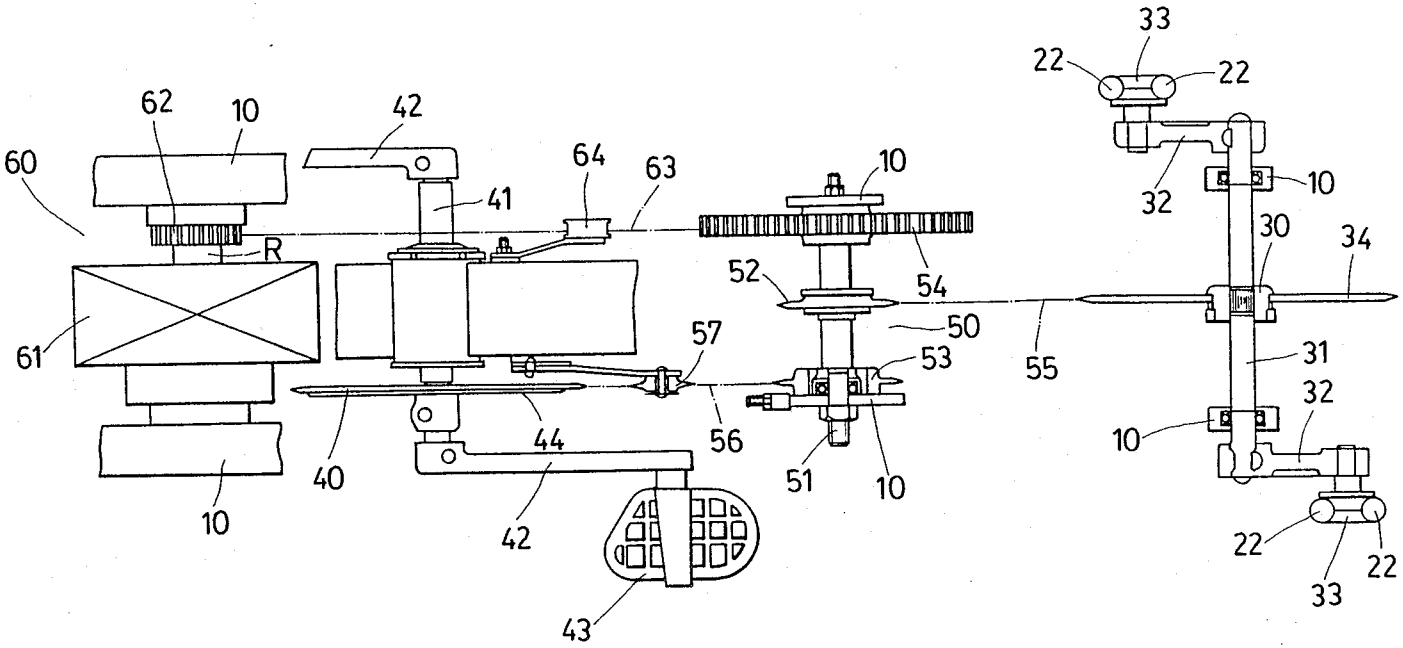
FIG. 2 is a top view showing the magnetically controlled exercise bicycle of this invention.

Referring to FIGS. 1 and 2, an exercise bicycle of this invention includes a frame assembly 10, a pair of swing levers 20, a front wheel assembly 30, a rear wheel assembly 40 and a magnetic controller 60.

The frame assembly 10 includes a frame 11. A seat 12 and a resistance setting device 13 are both disposed on the frame 11. The height of the seat 12 can be adjusted in a known manner.

The lower ends of the swing levers 20 are mounted pivotally on the frame 11. Each of the swing levers 20 has a grip 21 disposed at its top end, and two parallel rods 22 disposed at the intermediate portion of the swing lever 20. The rods 22 are coupled at the upper and lower ends thereof defining an lengthwise slide slot 23 therebetween. When one of the swing levers 20 is moved forward, the other one is moved backward.

The front wheel assembly 30 includes a front shaft 31 journalled on the front portion of the frame 11, two front crank arms 32, each secured to one of the two ends of the front shaft 31, two sheaves 33 respectively carried on said front crank arms 32, and a front wheel 34 sleeved rigidly on the front shaft 31. Each of the sheaves 33 is received slidably in one of the slide slots 23 of the swing levers 20.

The rear wheel assembly 40 includes a rear shaft 41 journalled on the rear portion of the frame 11, two rear crank arms 42 secured to two ends of the rear shaft 41, two pedals 43 respectively carried on the rear crank arms 42, and a rear wheel 44 sleeved rigidly on the rear shaft 41.

The intermediate wheel assembly 50 includes an intermediate shaft 51 journalled on the frame 11 between the front wheel assembly 20 and the rear wheel assembly 30. A hand-driven wheel 52 and a foot-driven wheel 53 are sleeved rotatably on the intermediate shaft 51. A driving wheel 54 is sleeved rigidly on the intermediate shaft 51. An endless first driving element 55 is trained between the front wheel 34 and the hand-driven wheel 52, while an endless second driving element 56 is trained between the rear wheel 44 and the foot-driven wheel 53. In this embodiment, the front wheel 34, the rear wheel 44, the hand-driven wheel 52 and the foot-driven wheel 53 are all sprockets, and the first driving element 55 and the second driving element 56 are chains. A first tensioning wheel 57 presses on a portion of the second driving element 56, which is positioned between the rear wheel 44 and the foot-driven wheel 53, so as to tighten the second driving element 56.

The magnetic controller 60 includes a generator 61 having an output end (not shown) connected to the resistance-setting device 13, and an input wheel 62 sleeved rigidly on a rotating shaft (R). The rotating shaft (R) is connected to the generator 61. An endless third driving element 63 is trained between the driving wheel 54 and the input wheel 62. In this embodiment, the driving wheel 54 and the input wheel 62 are gears, and the third driving element 63 is a timing belt. Alternatively, the driving wheel 54 and the input wheel 62 may be belt pulleys, and the third driving element 63 may be a V-belt. A second tensioning wheel 64 presses on a portion of the third driving element 63, which is positioned between the driving wheel 54 and the input wheel 62, so as tighten the third driving element 63.

Figure 3:
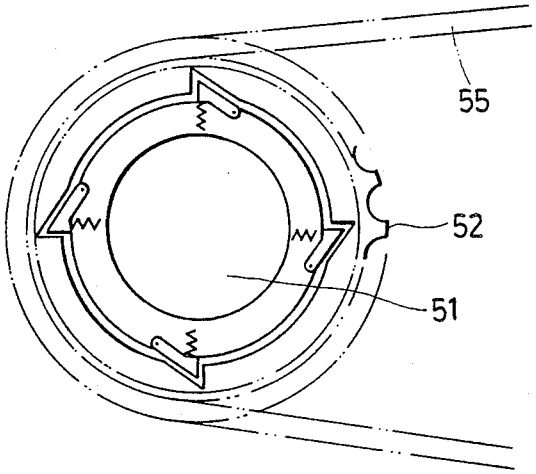
FIGS. 3 and 4 are schematic views illustrating the clutch means of the intermediate wheel assembly in accordance with this invention.
Figure 4:
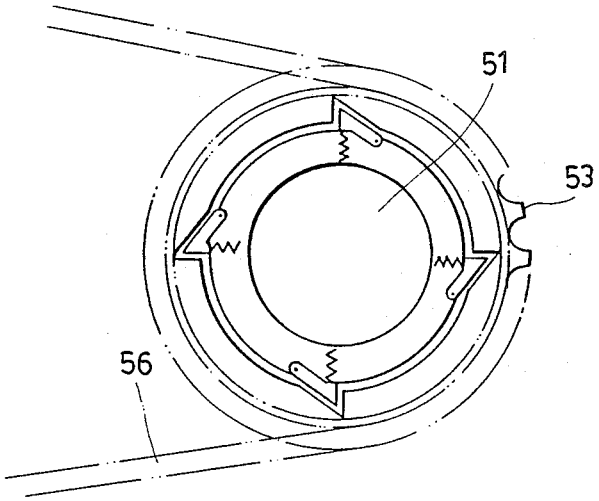

As shown in FIG. 3, a first clutch means is provided between the hand-driven wheel 52 and the intermediate shaft 51 so as to lock the hand-driven wheel 52 on the intermediate shaft 51 when the hand-driven wheel 52 rotates clockwise. Similarly, as shown in FIG. 4, a second clutch means is provided between the foot-driven wheel 53 and the intermediate shaft 51 so as to lock the foot-driven wheel 53 on the intermediate shaft 51 when the foot-driven wheel 53 rotates clockwise. The first and second clutch means are in the form of conventional ratchet mechanisms.

Because the feedback principle of the resistance setting device 13 is a technique known in other fields, a more detailed description thereof will be omitted.

When the swing levers 20 and/or the pedals 43 are actuated, the intermediate shaft 51 and the driving wheel 54 rotate clockwise. The rotation of the driving wheel 54 is transferred to the rotating shaft (R) of the magnetic controller 60 through the timing belt 63, so that the rotating shaft (R) activates the rotor (not shown) in the generator 61, thereby creating an electric current. The higher the rotational speed of the rotating shaft (R), the greater the electric current created by the generator 61. The signal representing the strength of the electric current created by the generator 61 is transmitted from the magnetic controller 60 to the resistance setting device 13 via an electric cord (not shown). Then, the resistance setting devices 13 evaluates the electrical current and sends a feedback signal to the generator 61 so as to generate a given degree of magnetic resistance in the generator 61, thereby giving an impedance to the rotation of the intermediate shaft and the actuation of the swing levers 20 and the pedals 43. Accordingly, the higher the rotational speed of the intermediate shaft 51, the greater the resistance to the rotation of the intermediate shaft 51, thereby increasing the exercise effect. The object of this invention is therefore achieved.

With this invention thus explained, it is apparent that numerous modifications and variations can be made without departing from the scope and spirit of this invention. It is therefore intended that this invention be limited only as indicated in the appended claims.

I claim:

1. An exercise bicycle comprising:

a frame assembly including a seat disposed thereon;

a pair of swing levers, connected pivotally to said frame assembly at lower ends of said swing levers, each of said swing levers having a lengthwise extending slide slot formed therein;

a front wheel assembly including a front shaft journalled on a front portion of said frame assembly, a front wheel sleeved rigidly on said front shaft, and two front crank arms, each secured to an end of said front shaft, said front crank arms being respectively received slidably in said slide slots;

a rear wheel assembly including a rear shaft journalled on a rear portion of said frame assembly, a rear wheel sleeved rigidly on said rear shaft under said seat, two rear crank arms secured to two ends of said rear shaft, and two pedals respectively carried on said rear crank arms;

an intermediate wheel assembly including an intermediate shaft journalled on said frame assembly between said front wheel assembly and said rear wheel assembly, a hand-driven wheel sleeved rotatably on said intermediate shaft, an endless first driving element trained between said front wheel and said hand-driven wheel so as to transfer rotation of said front wheel to said hand-driven wheel, a first clutch means for locking said hand-driven wheel on said intermediate shaft when said hand-driven wheel rotates in a predetermined direction, a foot-driven wheel sleeved rotatably on said intermediate shaft, an endless second driving element trained between said rear wheel and said foot-driven wheel so as to transfer rotation of said rear wheel to said foot-driven wheel, a second clutch means for locking said foot-driven wheel on said intermediate shaft when said foot-driven wheel rotates in said predetermined direction; and a resistance generating device including a resistance setting device disposed on said frame assembly, a driving wheel sleeved rigidly on said intermediate shaft, and a magnetic controller which includes a rotating shaft journalled on said frame assembly, an input wheel sleeved rigidly on said rotating shaft, an endless third driving element trained between said driving wheel of said intermediate wheel assembly and said input wheel so as to transfer rotation of said driving wheel to said input wheel, and a generator connected functionally to said rotating shaft and said resistance setting device, said generator creating current when said rotating shaft rotates, in such a manner that the higher rotational speed of said rotating shaft, the greater said current created from said generator, said resistance setting device feeding back a signal to said generator in response to changes in said current created by said generator so as to create magnetic resistance to rotation of said rotating shaft, in such a manner that the greater said current created from said generator, the greater said magnetic resistance to rotation of said rotating shaft.

2. An exercise bicycle as claimed in claim 1, wherein each of said front wheel and said hand-driven wheel is a sprocket, and said first driving element is a chain.

3. An exercise bicycle as claimed in claim 1, wherein each of said rear wheel and said foot-driven wheel is a sprocket, and said second driving element is a chain.

4. An exercise bicycle as claimed in claim 1, wherein each of said input wheel and said driving wheel is a gear, and said third driving element is a timing belt.

5. An exercise bicycle as claimed in claim 1, wherein a spring-biased first tensioning wheel presses on a portion of said second driving element which is positioned between said rear wheel and said foot-driven wheel, so as to tauten said second driving element.

6. An exercise bicycle as claimed in claim 1, wherein a spring-biased second tensioning wheel presses on a portion of said third driving element which is positioned between said driving wheel and said input wheel, so as to tauten said third driving element.

* * * * *